US007692084B1

(12) United States Patent
Lai

(10) Patent No.: US 7,692,084 B1
(45) Date of Patent: Apr. 6, 2010

(54) TENSION UNIT FOR A DRUM SET PEDAL

(76) Inventor: Mu-Sen Lai, No. 51-4, Fan-Po St., Fu-Hsin Hsiang, Changhwa Hsien (TW)

( * ) Notice: Subject to any disclaimer, the term of this patent is extended or adjusted under 35 U.S.C. 154(b) by 0 days.

(21) Appl. No.: 12/273,712

(22) Filed: Nov. 19, 2008

(51) Int. Cl.
*G10D 13/02* (2006.01)

(52) U.S. Cl. ..... 84/422.1; 84/422.2; 84/422.3

(58) Field of Classification Search ..... 84/422.1, 84/422.2, 422.3; 411/260
See application file for complete search history.

(56) References Cited

U.S. PATENT DOCUMENTS

| | | | | | |
|---|---|---|---|---|---|
| 3,400,742 | A * | 9/1968 | Wakabayashi | 411/260 |
| 3,655,227 | A * | 4/1972 | Orloff | 403/408.1 |
| 4,567,808 | A * | 2/1986 | Smith | 84/422.1 |
| 4,976,181 | A * | 12/1990 | Hsieh | 84/422.3 |
| 5,301,592 | A * | 4/1994 | Johnston | 84/422.1 |
| 5,343,792 | A * | 9/1994 | Liao | 84/422.1 |
| 5,365,824 | A * | 11/1994 | Hoshino | 84/422.1 |
| 5,646,360 | A * | 7/1997 | Liao | 84/422.1 |
| 5,773,736 | A * | 6/1998 | Hsieh | 84/422.1 |
| 6,211,449 | B1 * | 4/2001 | Lai | 84/422.1 |
| 6,239,342 | B1 * | 5/2001 | Chang | 84/422.1 |
| 6,259,012 | B1 * | 7/2001 | Hoshino | 84/422.1 |
| 6,713,667 | B2 * | 3/2004 | Shigenaga | 84/422.1 |
| 6,762,354 | B2 * | 7/2004 | Cocca | 84/422.1 |
| 6,822,149 | B1 * | 11/2004 | Liao | 84/422.1 |
| 7,122,730 | B2 * | 10/2006 | Takegawa | 84/422.1 |
| 7,297,852 | B1 * | 11/2007 | Chen | 84/422.1 |
| 7,301,088 | B2 * | 11/2007 | Chen | 84/422.1 |
| 7,326,843 | B2 * | 2/2008 | Tanaka | 84/422.3 |
| 7,368,650 | B2 * | 5/2008 | Hsieh | 84/422.1 |
| 7,408,104 | B2 * | 8/2008 | Sato | 84/422.1 |
| 7,601,902 | B1 * | 10/2009 | Lombardi | 84/422.1 |
| 2003/0047060 | A1 * | 3/2003 | Cocca | 84/422.1 |
| 2007/0006715 | A1 * | 1/2007 | Sato | 84/422.1 |
| 2008/0173159 | A1 * | 7/2008 | Chen | 84/422.1 |
| 2008/0196574 | A1 * | 8/2008 | Kjellgren | 84/422.1 |

* cited by examiner

*Primary Examiner*—Jeffrey Donels
*Assistant Examiner*—Robert W Horn
(74) *Attorney, Agent, or Firm*—Rabin & Berdo, P.C.

(57) ABSTRACT

A tension unit for a drum set pedal has a mounting shell, a lower locking nut, an upper locking nut, a threaded shaft and a spring. The mounting shell has an inner chamber, a mounting hole, at least one positioning protrusion and a locking ring. The positioning protrusion and locking ring are respectively formed on a top and bottom face of the mounting shell around the mounting hole. The lower locking nut has a threaded hole and an engaging ring engaging the locking ring. The upper locking nut abuts the top face of the mounting shell and has a threaded hole, a position ring engaging the positioning protrusion and an annular groove allowing the upper locking nut to flex. The threaded shaft is mounted through the mounting hole and the locking nuts and engages the locking nuts. The spring is connected to the threaded shaft.

9 Claims, 7 Drawing Sheets

TENSION UNIT FOR A DRUM SET PEDAL

BACKGROUND OF THE INVENTION

1. Field of the Invention

The present invention relates to a tension unit, and more particularly to a tension unit for a drum set pedal to remain tightened despite vibration for improved reliability.

2. Description of Related Art

With reference to FIGS. 6 and 7, a conventional drum set pedal (70) is implemented with a drum set, may be with a cymbal, drum or the like and comprises a base (71), a pedal (72), a mounting frame (73), a drive element (74) and a tension unit (75).

The base (71) is disposed adjacent to and may be attached to a percussion instrument such as a cymbal or drum and has a front end and a rear end. The pedal (72) is pivotally connected to the rear end of the base (71) and has a distal end.

The mounting frame (73) is mounted securely on the front end of the base (71) and has two stanchions (731), two mounting protrusions (732) and a rotating shaft (733). The stanchions (731) are mounted on and protrude from the front end of the base (71) parallel to each other. Each stanchion (731) has a proximal end, a distal end and an external surface. The proximal ends of the stanchions (731) are mounted on the base (71). The mounting protrusions (732) are respectively formed on and protrude from the external surfaces of the stanchions (731) near the proximal ends. The rotating shaft (733) is mounted rotatably in the distal ends of the stanchions (731), is keyed and has a connecting end and a cam. The connecting end of the rotating shaft (733) is mounted through the distal end of a corresponding stanchion (731). The cam is mounted on the connecting end of the rotating shaft (733).

The drive element (74) is attached securely to and protrudes from the rotating shaft (733) of the mounting frame (73), may be a cymbal rod or a drum hammer and has a chain (741) connecting the distal end of the pedal (72) to the drive element (74).

The tension unit (75) is mounted on a corresponding stanchion (731) and is connected to the connecting end of the rotating shaft (733) and has a threaded shaft (751), two nuts (752) and a spring (753). The threaded shaft (751) is mounted through the mounting protrusion (732) of the corresponding stanchion (731) and has a lower end, an upper end and a spring mount. The spring mount is formed in the upper end of the threaded shaft (751). The nuts (752) are mounted around and engage the threaded shaft (751) and each nut (752) has a washer (754) pressing against the mounting protrusion (732) of the corresponding stanchion (731). The spring (753) is connected to the cam of the rotating shaft (733) and the spring mount of the threaded shaft (751).

When the pedal (72) is actuated, the chain (741) rotates the rotating shaft (733) and drive element (74) so the drive element (74) sounds the cymbal or drum. Then the spring (753) provides a returning force to rotate the rotating shaft (733) and returns the pedal (72). The threaded shaft (752) can be adjusted relative to the mounting protrusion (732) of the mounting frame (73) using the nuts (752) to adjust the returning force of the spring (753).

However, when fastening the nuts (752) with the threaded shaft (751), determining when the nuts (752) are sufficiently tight is not possible so may cause over-rotation of the nuts (752) inducing excessive wear. Further, vibration caused by using the drum set pedal (70) and produced by the drum set may cause the nuts (752) to loosen and the drum set pedal (70) to malfunction, therefore causing inconvenience and unreliability to a player.

To overcome the shortcomings, the present invention provides a tension unit for a drum set beater to mitigate or obviate the aforementioned problems.

SUMMARY OF THE INVENTION

The main objective of the present invention is to provide a tension unit for a drum set that remains tightened despite vibration for improved reliability.

The tension unit for a drum set pedal has a mounting shell, a lower locking nut, an upper locking nut, a threaded shaft and a spring. The mounting shell has an inner chamber, a mounting hole, at least one positioning protrusion and a locking ring. The positioning protrusion and locking ring are respectively formed on a top and bottom face of the mounting shell around the mounting hole. The lower locking nut has a threaded hole and an engaging ring engaging the locking ring. The upper locking nut abuts the top face of the mounting shell and has a threaded hole, a position ring engaging the positioning protrusion and an annular groove allowing the upper locking nut to flex. The threaded shaft is mounted through the mounting hole and the locking nuts and engages the locking nuts. The spring is connected to the threaded shaft.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
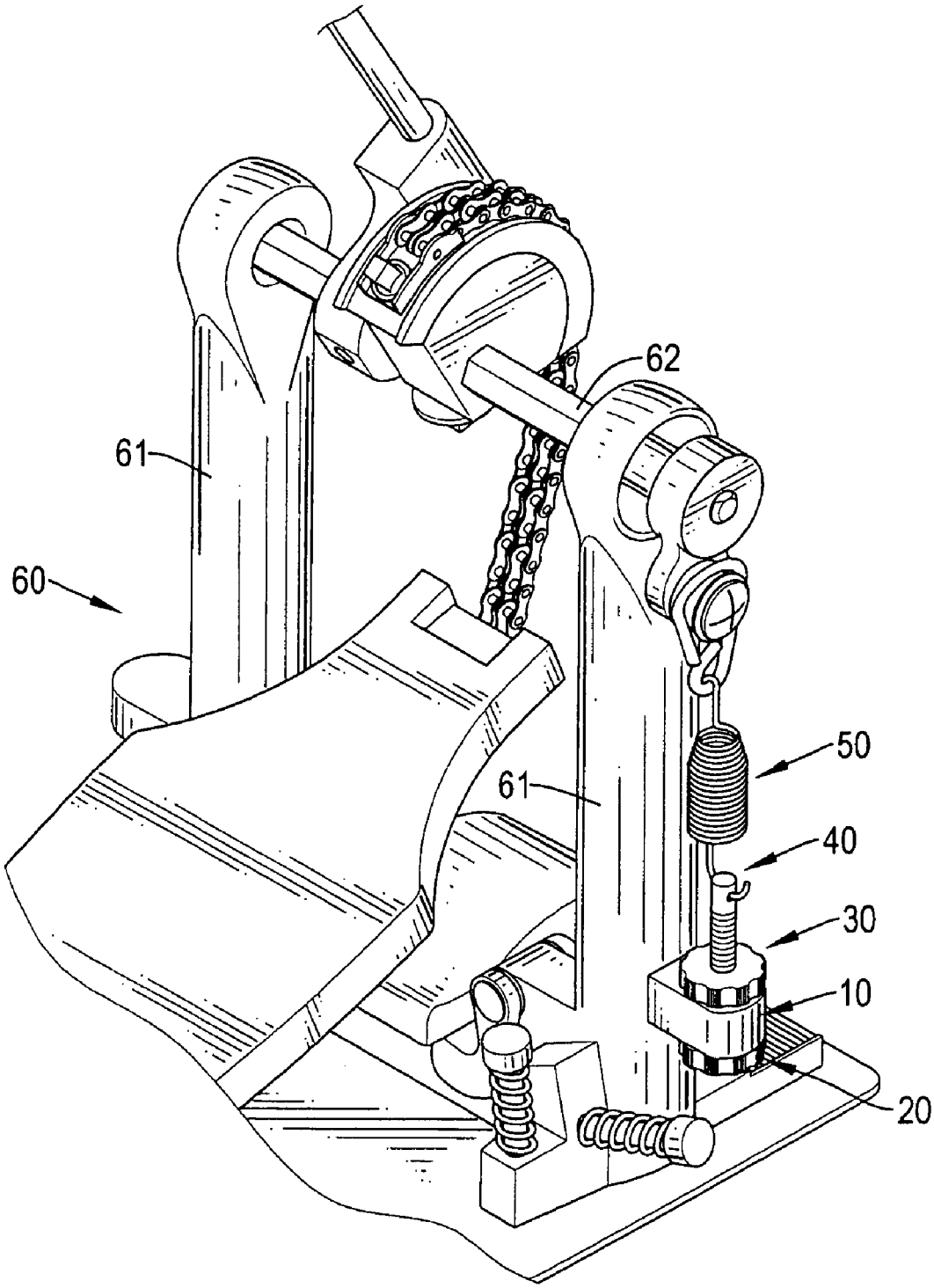
FIG. 1 is a perspective view of a tension unit in accordance with the present invention mounted on a drum set pedal.
Figure 2:
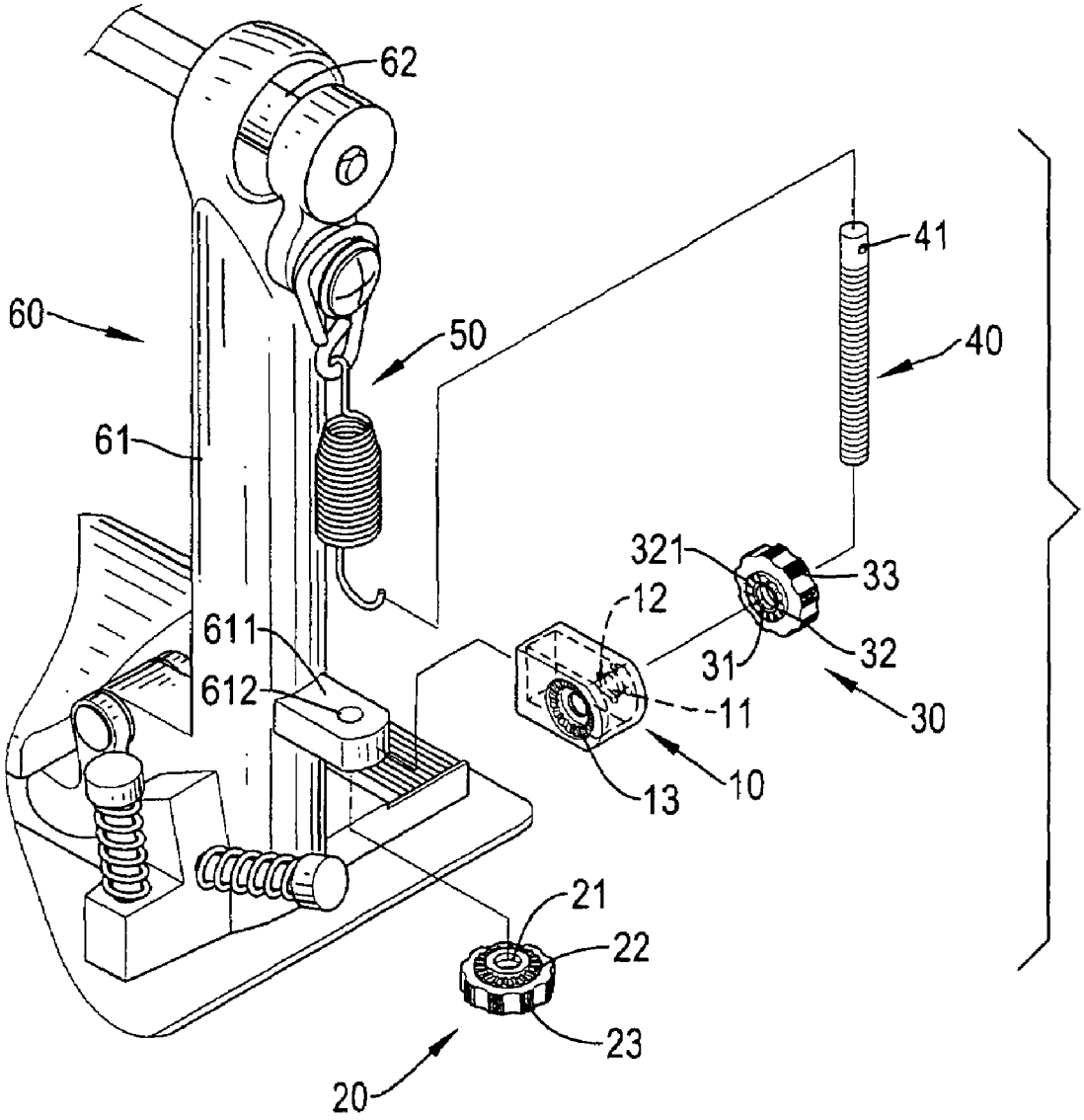
FIG. 2 is an enlarged, partially exploded perspective view of the tension unit in FIG. 1.
Figure 3:
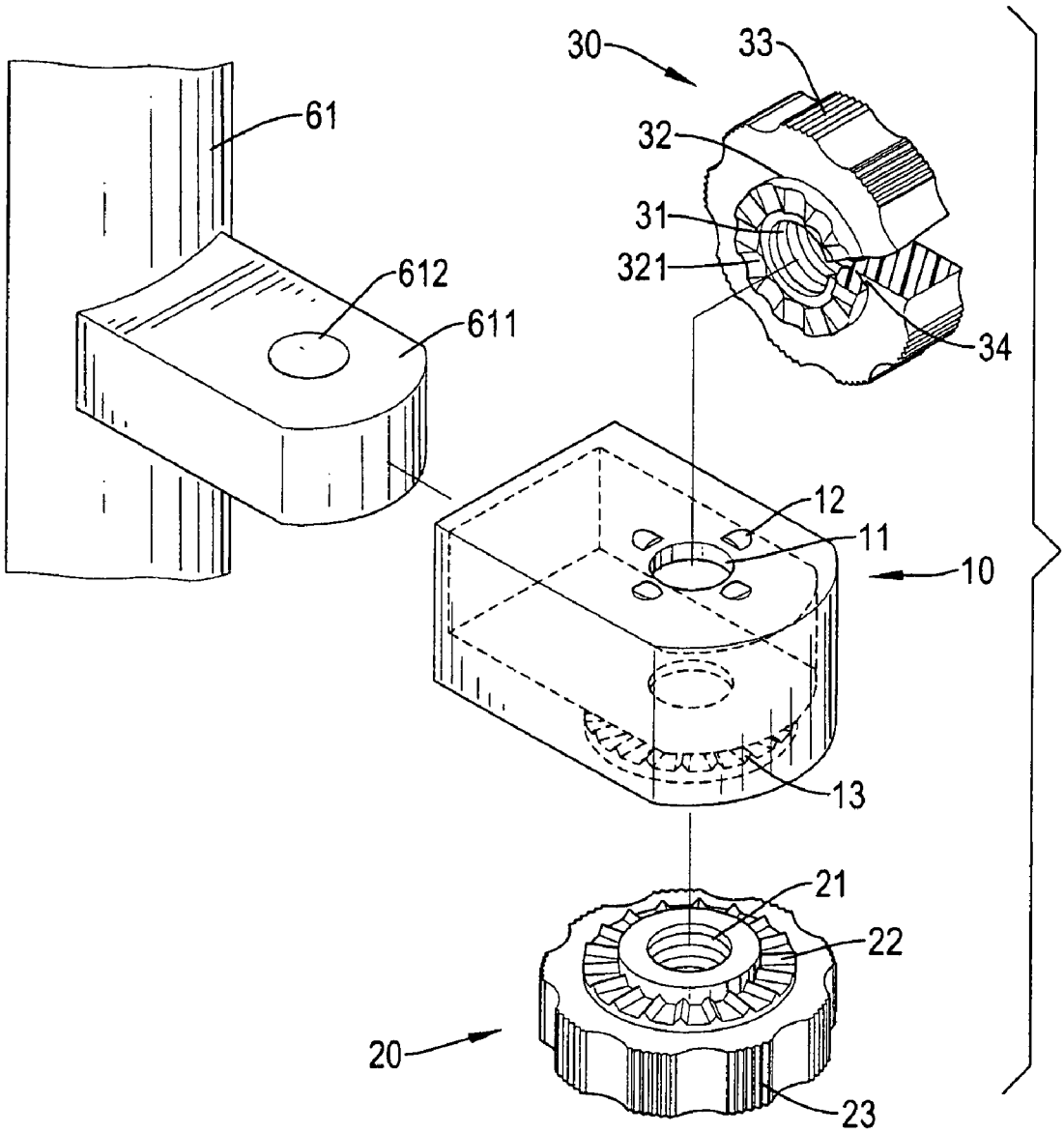
FIG. 3 is an enlarged exploded perspective view of the tension unit in FIG. 2 with features of a mounting shell shown in phantom lines.

With reference to FIGS. 1, 2 and 3, a tension unit in accordance with the present invention is mounted on a drum set pedal (60) between a stanchion (61) and a rotating shaft (62) and comprises a mounting shell (10), a lower locking nut (20), an upper locking nut (30), a threaded shaft (40) and a spring (50).

The stanchion (61) of the drum set pedal (60) has a proximal end, a distal end, an external surface and a mounting protrusion (611). The mounting protrusion (611) is formed on and protrudes from the external surfaces of the stanchion (61) near the proximal end and has a through hole (612). The through hole (612) is formed through the mounting protrusion (611).

The rotating shaft (62) is mounted rotatably in the distal end of the stanchion (61) and has a mounting end protruding through the distal end of the stanchion (61) and a cam mounted thereon.

The mounting shell (10) is mounted securely around the mounting protrusion (611) of the stanchion (61) and has an inner chamber, a middle, a top face, a bottom face, a mounting hole (11), at least one positioning protrusion (12) and a locking ring (13). The inner chamber corresponds to and is mounted on the mounting protrusion (611). The mounting hole (11) is formed through the mounting shell (10) from the top face to the bottom face and aligns with the through hole (612) of the mounting protrusion (611). The at least one positioning protrusion (12) may align with and be arched perpendicular to a radius of the mounting hole (11), is formed on and protrudes from the top face of the mounting shell (10) near the mounting hole (11), and four positioning protrusions (12) may be implemented and spaced evenly around the mounting hole (11). The locking ring (13) is formed on the bottom face of the mounting shell (10) around the mounting hole (11) and may be recessed. The locking ring (13) may comprise multiple protrusions being trapezoid in cross section and tapered to a center of the locking ring (13) and multiple indentations being triangular in cross section and tapered to the center of the locking ring (13).

The lower locking nut (20) abuts the bottom face of the mounting shell (10) and has a center, an external surface, an inner surface, a threaded hole (21), an engaging ring (22) and a grip (23). The inner surface of the lower locking nut (20) abuts the bottom face of the mounting shell (10). The threaded hole (21) is formed through the center of the lower locking nut (20) and aligns with the mounting hole (11) of the mounting shell (10). The engaging ring (22) is formed on and protrudes from the top face of the lower locking nut (20) around the threaded hole (21), corresponds to and engages the locking ring (13) of the mounting shell (10) and may comprise multiple protrusions being triangular in cross section and being tapered toward the center of the locking nut (20) and multiple recesses being trapezoid in cross section and being tapered to the center of the locking nut (20). The grip (23) is formed on the external surface of the lower locking nut (20) and may comprise multiple ribs formed on the external surface at intervals and multiple concavities.

The upper locking nut (30) abuts the top face of the mounting shell (10) and has a center, an external surface, an outer surface, an inner surface, a threaded hole (31), a position ring (32), an annular groove (34) and a grip (33). The inner surface of the upper locking nut (30) abuts the top face of the mounting shell (10). The threaded hole (31) is formed through the center of the upper locking nut (30) and aligns with the mounting hole (11) of the mounting shell (10) and the threaded hole (21) of the lower locking nut (20). The position ring (32) is formed on and protrudes from the bottom face of the upper locking nut (30) around the threaded hole (31), abuts the at least one positioning protrusion (12) of the mounting shell (10) and has an inner face and multiple dents (321). The dents (321) are formed on the inner face of the position ring (32) and selectively abut the at least one positioning protrusion (12) of the mounting shell (10) and may be arched. The annular groove (34) is formed around the upper locking nut (30) between the position ring (32) and the outer surface of the upper locking nut (30) to allow the upper locking nut (30) to flex. The grip (33) of the upper locking nut (30) is formed on the external surface of the upper locking nut (30) and may comprise multiple ribs formed on the external surface of the upper locking nut (30) at intervals and multiple concavities.

The threaded shaft (40) is mounted through the through hole (612) of the mounting protrusion (611) and the mounting hole (11) of the mounting shell (10), engages the locking nuts (20, 30) and has a lower end, an upper end and a spring mount (41). The spring mount (41) is formed radially through the upper end of the threaded shaft (40).

The spring (50) is connected to the upper end, may be to the spring mount (41), of the threaded shaft (40) and the cam of the rotating shaft (62) of the drum set pedal (60).

Figure 4:
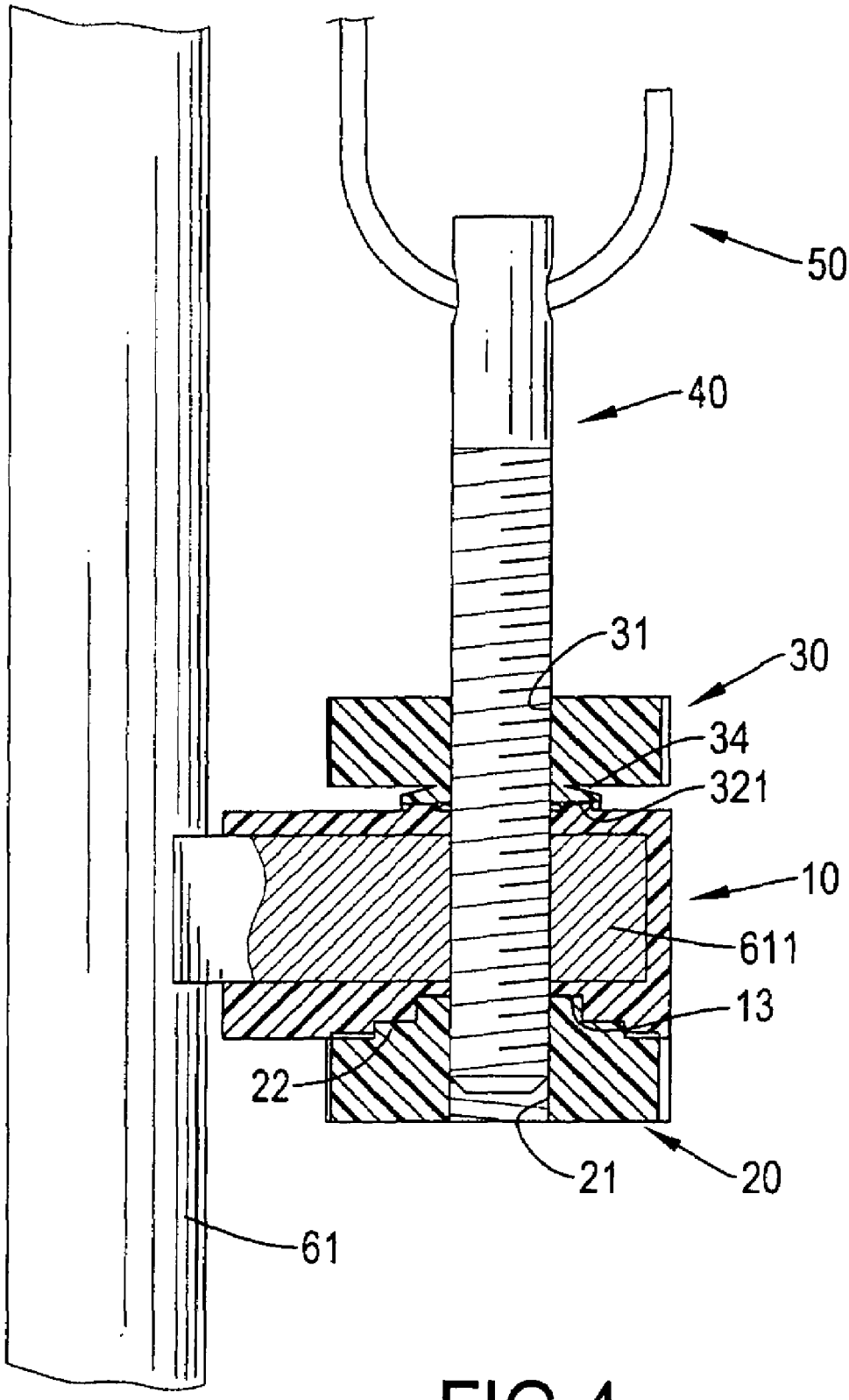
FIG. 4 is an enlarged side view in partial section of the tension unit in FIG. 1, mounted on a drum set beater.
Figure 5:
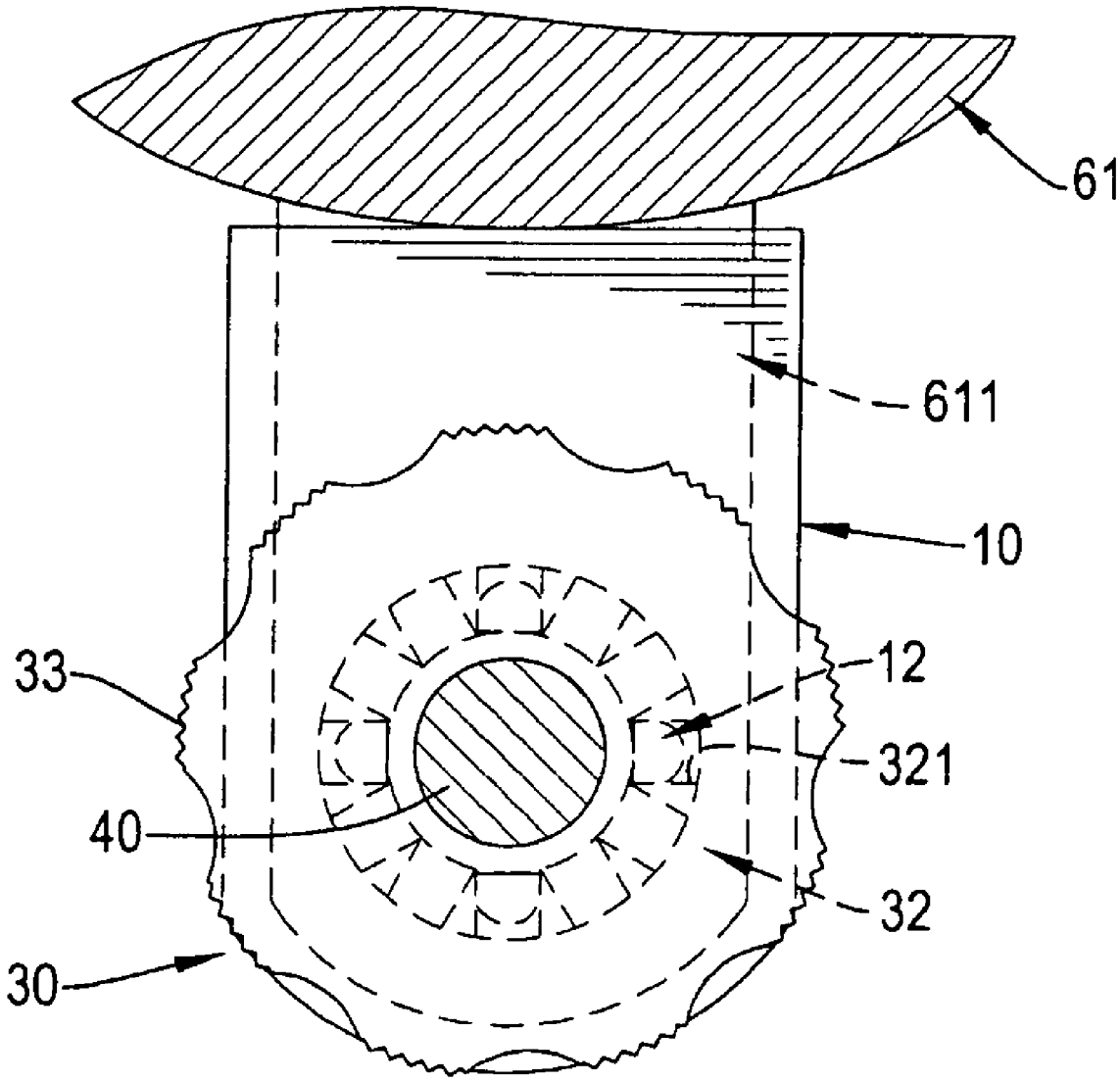
FIG. 5 is an enlarged top view of the tension unit in FIG. 1, showing an upper locking nut engaging the mounting shell.
Figure 6:
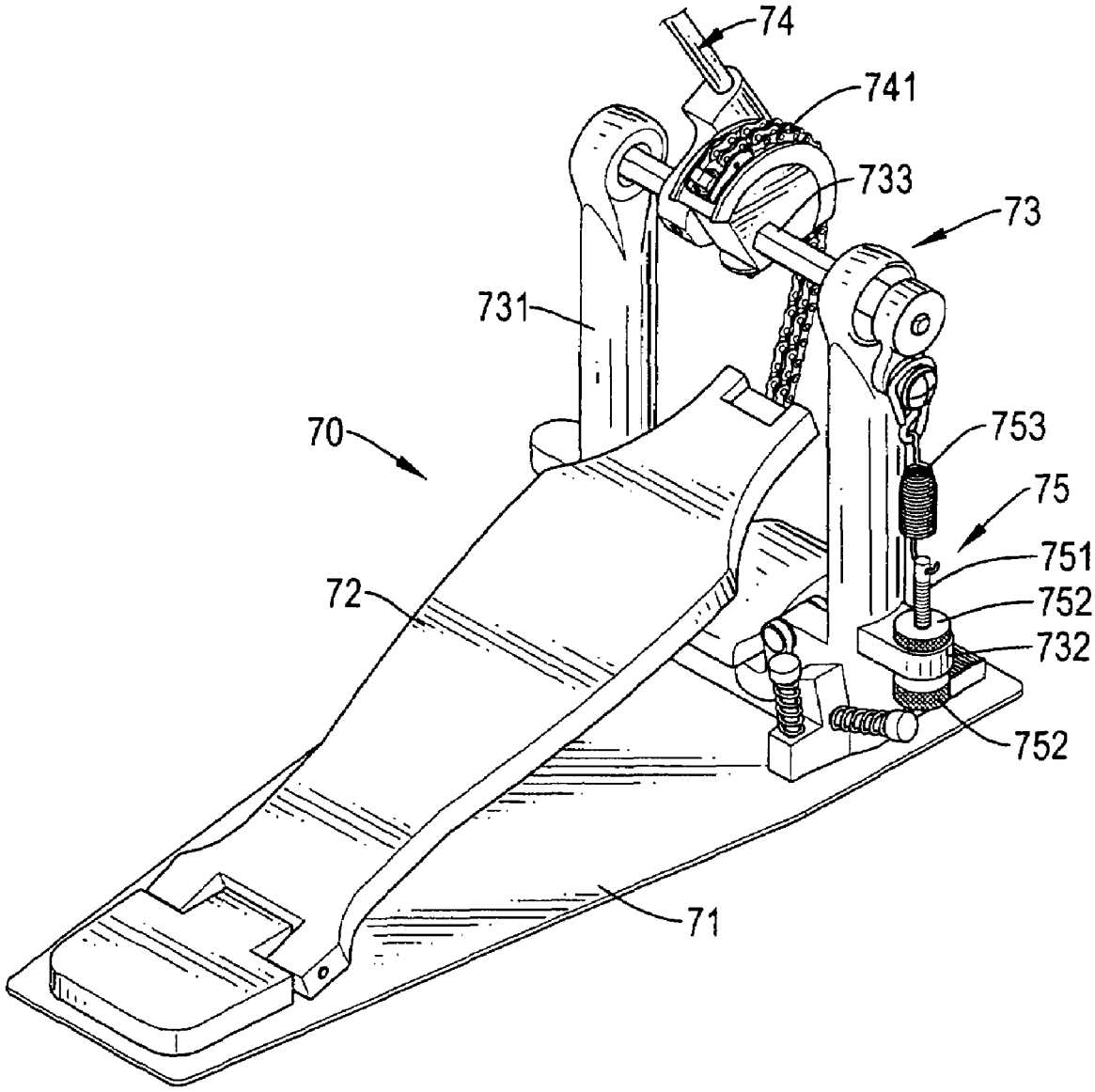
FIG.6 PRIOR ART
FIG. 6 is a perspective view of a conventional drum set pedal in accordance with the prior art.
Figure 7:
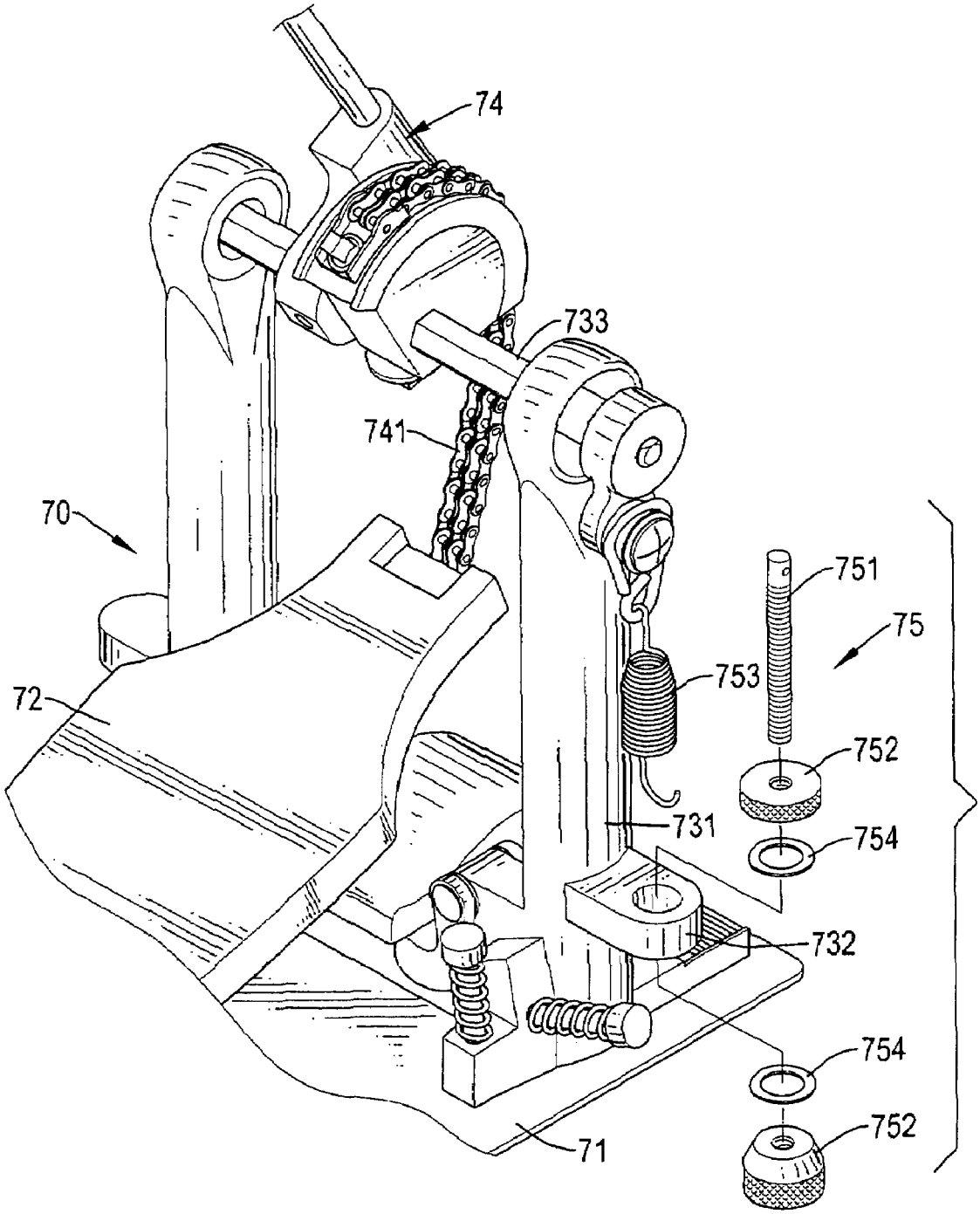
FIG.7 PRIOR ART
FIG. 7 is an enlarged, partially exploded perspective view of a tension unit of the conventional drum set pedal in FIG. 6.

With further reference to FIGS. 4 and 5, when adjusting the tension unit relative to the drum set pedal (60), the lower locking nut (20) is loosened to allow the engaging ring (22) to disengage from the locking ring (13) of the mounting shell (10). When the lower locking nut (20) disengages from the threaded shaft (40), the upper locking nut (30) is loosened to disengage the position ring (32) from the at least one positioning protrusion (12). Therefore, the threaded shaft (40) can be moved relative to the mounting shell (10) and the mounting protrusion (611) of the drum set pedal (60) to adjust an elastic force of the spring (50) to change a returning force of the rotating shaft (62) of the drum set pedal (60).

After adjusting the threaded shaft (40) and the spring (50), the lower locking nut (20) is fastened against the threaded shaft (40) so the engaging ring (22) engages the locking ring (13) of the mounting shell (10). When the engaging ring (22) engages the locking ring (13), the lower locking nut (20) cannot rotate relative to the mounting shell (10) and the threaded shaft (40). Then, the upper locking nut (30) is fastened along the threaded shaft (40) against the mounting shell (10). When the position ring (32) of the upper locking nut (30) contacts and engages the at least one positioning protrusion (12), the annular groove (34) allows the position ring (32) of the upper locking nut (30) to deform and the upper locking nut (30) rotate. Therefore, the locking nuts (20, 30) are connected securely to the threaded shaft (40) and the mounting shell (10) and vibration will not cause the locking nuts (20, 30) to rotate.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A tension unit for a drum set beater having a mounting shell having an inner chamber;

a middle;

a top face;

a bottom face;

a mounting hole being formed through the mounting shell from the top face to the bottom face;

at least one positioning protrusion being formed on and protruding from the top face of the mounting shell near the mounting hole; and a locking ring being formed on the bottom face of the mounting shell around the mounting hole;

a lower locking nut abutting the bottom face of the mounting shell and having a center;

an external surface;

an inner surface abutting with the bottom face of the mounting shell;

a threaded hole being formed through the center of the lower locking nut and aligning with the mounting hole of the mounting shell; and an engaging ring being formed on and protruding from the top face of the lower locking nut around the threaded hole, corresponding to and engaging the locking ring of the mounting shell;

an upper locking nut abutting the top face of the mounting shell and having a center;

an external surface;

an outer surface;

an inner surface abutting with the top face of the mounting shell;

a threaded hole being formed through the center of the upper locking nut and aligning with the mounting hole of the mounting shell and the threaded hole of the lower locking nut;

a position ring being formed on and protruding from the bottom face of the upper locking nut around the threaded hole and abutting the at least one positioning protrusion of the mounting shell; and an annular groove being formed around the upper locking nut between the position ring and the bottom face of the upper locking nut;

a threaded shaft being mounted through the mounting hole of the mounting shell, engaging the locking nuts and having a lower end;

an upper end; and a spring being connected to the upper end of the threaded shaft.

2. The tension unit as claimed in claim 1, wherein the position ring further has an inner face; and multiple dents being formed on the inner face of the position ring and selectively abutting the at least one positioning protrusion of the mounting shell.

3. The tension unit as claimed in claim 2, wherein the lower locking nut further has a grip being formed on the external surface of the lower locking nut; and the upper locking nut further has a grip being formed on the external surface of the upper locking nut.

4. The tension unit as claimed in claim 3, wherein the threaded shaft further has a spring mount being formed radially through the upper end of the threaded shaft, wherein the spring is mounted through the threaded spring mount.

5. The tension unit as claimed in claim 4, wherein the mounting shell has four positioning protrusions being formed on the top face of the mounting shell and spaced evenly around the mounting hole.

6. The tension unit as claimed in claim 5, wherein each positioning protrusion of the mounting shell is arched.

7. The tension unit as claimed in claim 1, wherein the threaded shaft further has a spring mount being formed radially through the upper end of the threaded shaft, wherein the spring is mounted in the spring mount of the threaded shaft.

8. The tension unit as claimed in claim 1, wherein the mounting shell has four positioning protrusions being formed on the top face of the mounting shell and spaced evenly around the mounting hole.

9. The tension unit as claimed in claim 1, wherein each positioning protrusion of the mounting shell is arched.

* * * * *